US007669285B2

(12) United States Patent
Gallasch et al.

(10) Patent No.: US 7,669,285 B2
(45) Date of Patent: Mar. 2, 2010

(54) DAMPING DEVICE FOR FURNITURE HINGES

(75) Inventors: Steffen Gallasch, Erbach (DE); Gabriele Schneider, Fuerth (DE); Gerd Voelker, Riedstadt (DE)

(73) Assignee: MEPLA-Werke Mautenschlaeger GmbH & Co. KG, Reinheim (DE)

( * ) Notice: Subject to any disclaimer, the term of this patent is extended or adjusted under 35 U.S.C. 154(b) by 705 days.

(21) Appl. No.: 10/598,754

(22) PCT Filed: Aug. 6, 2004

(86) PCT No.: PCT/EP2004/008806

§ 371 (c)(1),
(2), (4) Date: Sep. 11, 2006

(87) PCT Pub. No.: WO2005/088052

PCT Pub. Date: Sep. 22, 2005

(65) Prior Publication Data

US 2007/0157429 A1 Jul. 12, 2007

(30) Foreign Application Priority Data

Mar. 12, 2004 (DE) ..... 20 2004 003 862 U

(51) Int. Cl.
*E05F 1/08* (2006.01)

(52) U.S. Cl. ..... 16/286

(58) Field of Classification Search ..... 16/286, 16/84, 85; 74/574.2; 188/290, 306
See application file for complete search history.

(56) References Cited

U.S. PATENT DOCUMENTS 4,085,481 A 4/1978 Lautenschlager
4,870,716 A * 10/1989 Grass ..... 16/251

(Continued)

FOREIGN PATENT DOCUMENTS

DE 297 17 508 U1 8/1998

(Continued)

*Primary Examiner*—Victor Batson
*Assistant Examiner*—Matthew Sullivan
(74) *Attorney, Agent, or Firm*—Norris McLaughlin & Marcus, PA

(57) ABSTRACT

Damping device (30) for hinges (10) for the pivotable articulation of door leaves (12) or door flaps on the carcass of pieces of furniture, in which the hinge has respectively a supporting wall mounting part (18) which can be fixed on the supporting wall (14) and a door leaf mounting part (24) which is pivotably coupled via a linkage mechanism (20; 22) to the supporting wall mounting part and can be fixed on the inner face of the door leaf or flap, and which is preferably constructed as a cup part which is countersunk and engages in a recess in the door leaf or flap and has a laterally projecting fixing flange which bears on the inner face of the door leaf.

The damping device (30) has a damper housing which is provided on the door leaf mounting part (24) and which is provided in the cavity thereof with a fluid or gaseous damping medium and a resistance element which is movable relative to the damping medium and is coupled to an actuating element (39) which extends out of the housing. At least during part of the pivoting movement of the mounting parts (18, 24) relative to one another the actuating element is in engaged connection directly or indirectly with the supporting wall mounting part (18) and transmits to the resistance element the relative movement of the mounting parts as they pivot.

The damper housing (32) is a separate component which is provided with laterally projecting fixing flanges (38, 46) which can be fixed on the fixing flanges of the door leaf mounting part (24).

7 Claims, 5 Drawing Sheets

U.S. PATENT DOCUMENTS

| | | | | |
|---|---|---|---|---|
| 5,195,214 | A | 3/1993 | Lautenschlager et al. | |
| 5,829,814 | A * | 11/1998 | Niessner et al. | 296/37.12 |
| 6,408,483 | B1 * | 6/2002 | Salice | 16/85 |
| 7,194,785 | B2 * | 3/2007 | Li | 16/85 |
| 7,275,284 | B2 * | 10/2007 | Lautenschlager et al. | 16/287 |
| 7,340,799 | B2 * | 3/2008 | Salice | 16/84 |
| 2002/0046441 | A1 | 4/2002 | Brustle | |
| 2005/0015927 | A1 * | 1/2005 | Kropf | 16/286 |

FOREIGN PATENT DOCUMENTS

| | | | |
|---|---|---|---|
| EP | 0 610 765 | A1 | 8/1994 |
| EP | 1 103 685 | A2 | 5/2001 |
| JP | 2006169777 | A * | 6/2006 |
| JP | 2006200160 | A * | 8/2006 |
| WO | 03 004817 | A1 | 1/2003 |

* cited by examiner

DAMPING DEVICE FOR FURNITURE HINGES

The invention relates to a damping device for furniture hinges for the pivotable articulation of door leaves or door flaps on the carcass of pieces of furniture, in which the hinge has respectively a supporting wall mounting part which can be fixed on the supporting wall of the carcass and a door leaf mounting part which is pivotably coupled via a linkage mechanism to the supporting wall mounting part and can be fixed on the inner face of the door leaf or flap, preferably as a door leaf mounting part which is countersunk and engages in a recess in the door leaf or flap and which has laterally projecting fixing flanges which bear on the inner face, wherein the damping device has a damper housing which is provided on the door leaf mounting part and which is provided in the cavity thereof with a fluid or gaseous damping medium and a resistance element which is movable relative to the damping medium and is coupled to an actuating element which extends out of the housing, wherein at least during part of the pivoting movement of the mounting parts relative to one another the actuating element is in engaged connection directly or indirectly with the supporting wall mounting part and transmits to the resistance element the relative movement of the mounting parts as they pivot.

Damping devices on door leaves serve to avoid or at least largely to reduce the noises produced by stresses during rapid and vigorous closing of doors of cupboards during the jerky braking of the door leaf striking the carcass. Such damping devices which operate with gaseous substances, such as for example atmospheric air or with viscous fluids, such as for example silicone oil, as damping medium are known per se.

WO 03/004817 A1 (FIGS. 11 and 12) for example discloses a damping device which is provided as a door leaf mounting part constructed as a hinge cup which can be fixed countersunk in the associated door leaf, the damper housing being an integral part of the door leaf mounting part. The hinge cup is produced in a die-casting process from a suitable alloy (zamak). It is clear that the production of the hinge cup, which is relatively complex in casting terms, with a cast-on damper housing is expensive. Re-equipping of normal, i.e. undamped hinges in such a way that in special cases they make damped braking of a door leaf possible as it approaches its closed position is not possible—or is possible only with difficulties—because the normal hinge cup would have to be replaced by a hinge cup with integrated damper housing for this purpose.

By contrast, the object of the invention is to provide a damping device for hinges of the type in question here which allows the re-equipping or retrofitting of hinges without a damping device in hinges with a damping function.

Starting from a damping device of the type referred to in the introduction, this object is achieved according to the invention in that the damper housing is a separate component which is provided with laterally projecting fixing flanges which can be fixed on the fixing flanges of the door leaf mounting part.

In a first embodiment of the invention at least some areas of the fixing flanges of the damper housing are shaped so that they correspond substantially to the outer boundary of the fixing flanges of the door leaf mounting part and are provided in their edge region with a projecting narrow edge which engages over the edges of the fixing flanges of the door leaf mounting part in the prescribed fixing position on the door leaf mounting part, wherein fixing means are provided for releasable connection of the edge portions to the edges of the fixing flanges of the door leaf mounting part.

The fixing means are preferably formed by projections on the narrow edge portions which can be latched on or under the edges of the fixing flanges of the door leaf mounting part. In this way it is possible to latch the damping device at a later stage if required onto the fixing flanges of the door leaf mounting part without separate tools being necessary for this.

In normal hinges in which the door leaf mounting part constructed as a hinge cup is screwed to the appertaining door leaf by fixing screws passing through holes in the fixing flanges, holes in the fixing flanges of the damper housing which are aligned with the holes in the fixing flanges of the hinge cup can also be provided as fixing means, so that the fixing of the damper housing can then be achieved together with the fixing of the hinge cup by—appropriate lengthened—fixing screws.

In hinges in which the door leaf mounting parts are provided in the region of their fixing flanges with a plate which is intended for covering of the fixing flanges and/or actuation of additional fixing means for the mounting part and which at least covers parts of the fixing flanges in the prescribed covered or fixed position bearing on the fixing flange, wherein the said plate is disposed so that it can be pivoted up about an axis extending parallel to the hinge pivot axis on the door leaf stop part (e.g. EP 0 610 765 A1 or DE 297 17 508 U1), an embodiment of the damping device is advantageous in which the fixing flanges projecting from the damper housing are formed by thin flat tab-like extensions which only cover parts of the fixing flanges of the door leaf mounting part and which when the covering or fixing plate of the door leaf mounting part is pivoted up can be placed on associated areas of the fixing flanges of the door leaf mounting part and can be releasably connected to the fixing flanges of the mounting part and can be covered and secured against separation from the door leaf mounting part after the covering or fixing plate of the door leaf mounting part has been pivoted down.

The connection of the regions of the tab-like extensions of the damper housing and of the fixing flanges of the door leaf mounting part is advantageously achieved by fixing projections and recesses which interengage so as to interlock.

In a preferred embodiment of the invention at least one through hole is provided in each of the tab-like extensions of the damper housing and each such hole can be placed onto an associated projection of the fixing flanges of the door leaf mounting part which is of complementary shape in cross-section.

As additional securing means, in the regions of the tab-like extensions of the damper housing and the opposing regions of the fixing flanges of the door leaf mounting part which lie one above the other in the prescribed covering or fixing position, in each case at least one further aligned through hole is provided through which the shank of an additional fixing screw can pass in each case, wherein after the through holes in the tab-like extensions have been placed onto the associated projections the additional fixing screw can prevent unwanted separation of the tab-like extensions from the associated fixing flanges. The head of these additional fixing screws is covered by the covering or fixing plate which has been pivoted down in the prescribed installation position of the door leaf mounting part on or in the associated door leaf.

The invention is explained in greater detail in the following description of three embodiments in conjunction with the drawings, in which.

Figure 6:
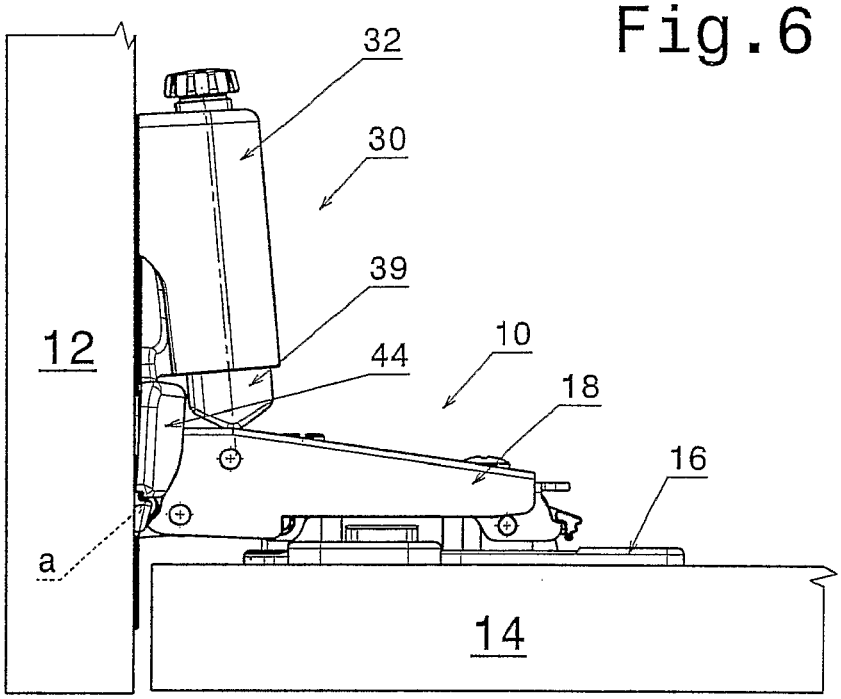
FIG. 6 shows a view corresponding to FIG. 1 of a second embodiment of a hinge provided with a damper device.
Figure 7:
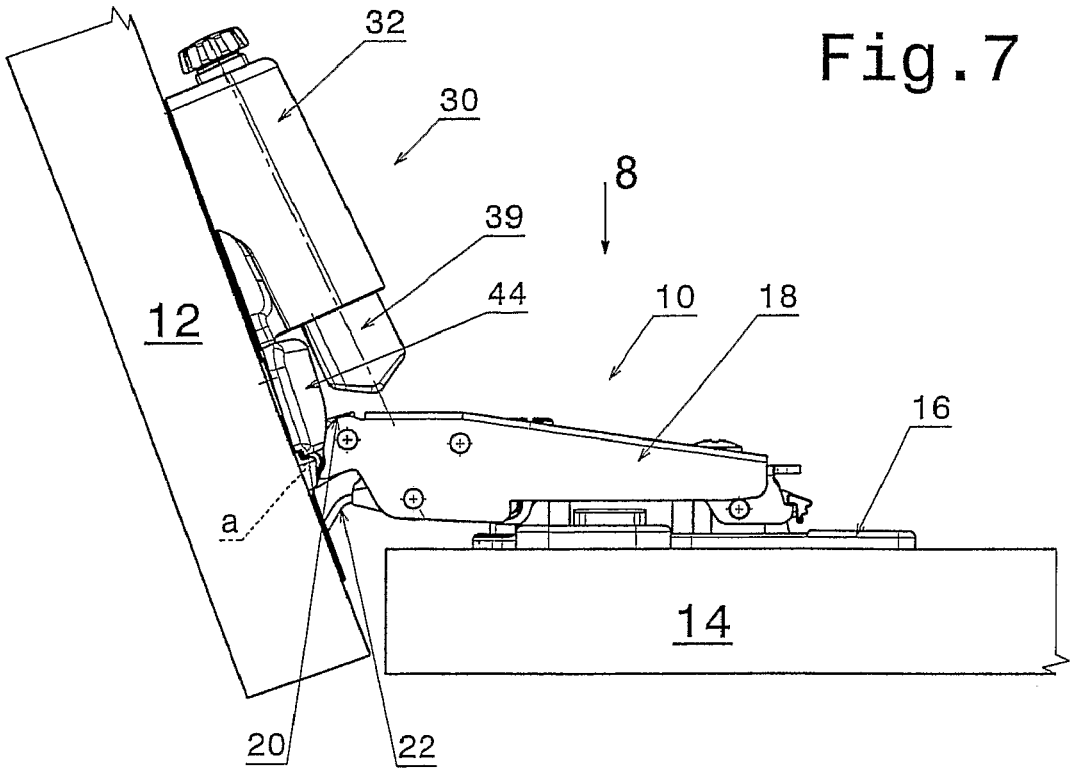
FIG. 7 shows a view corresponding to FIG. 2 of the embodiment shown in FIG. 6.
Figure 8:
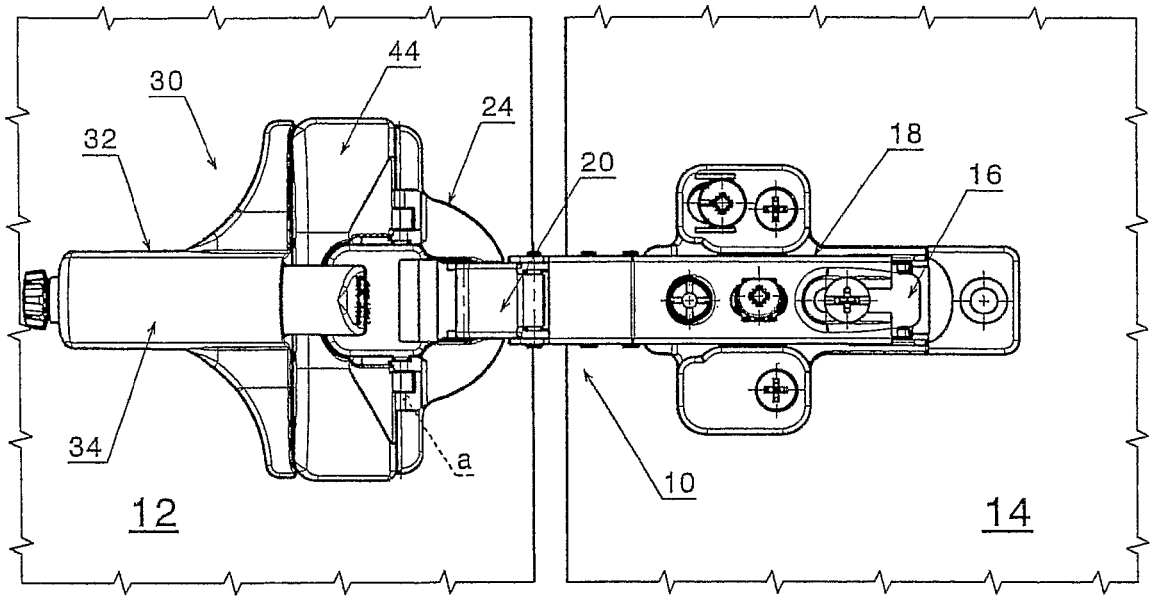
FIG. 8 shows a plan view corresponding to FIG. 3 of the embodiment shown in FIGS. 6 and 7.
Figure 9:
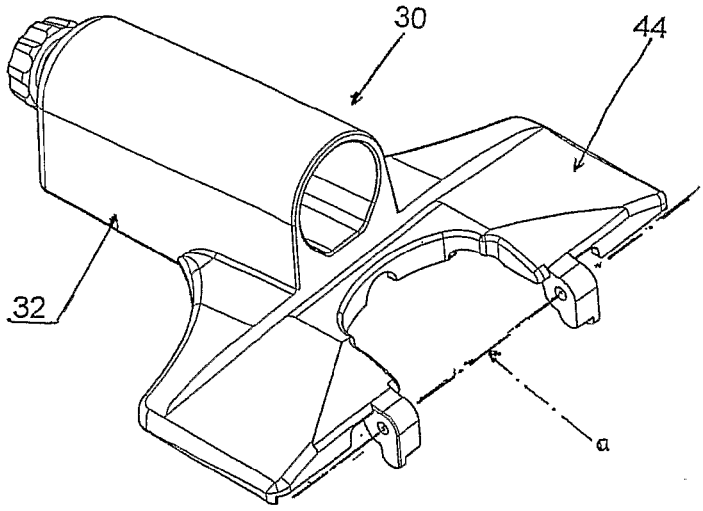
Figure 10:
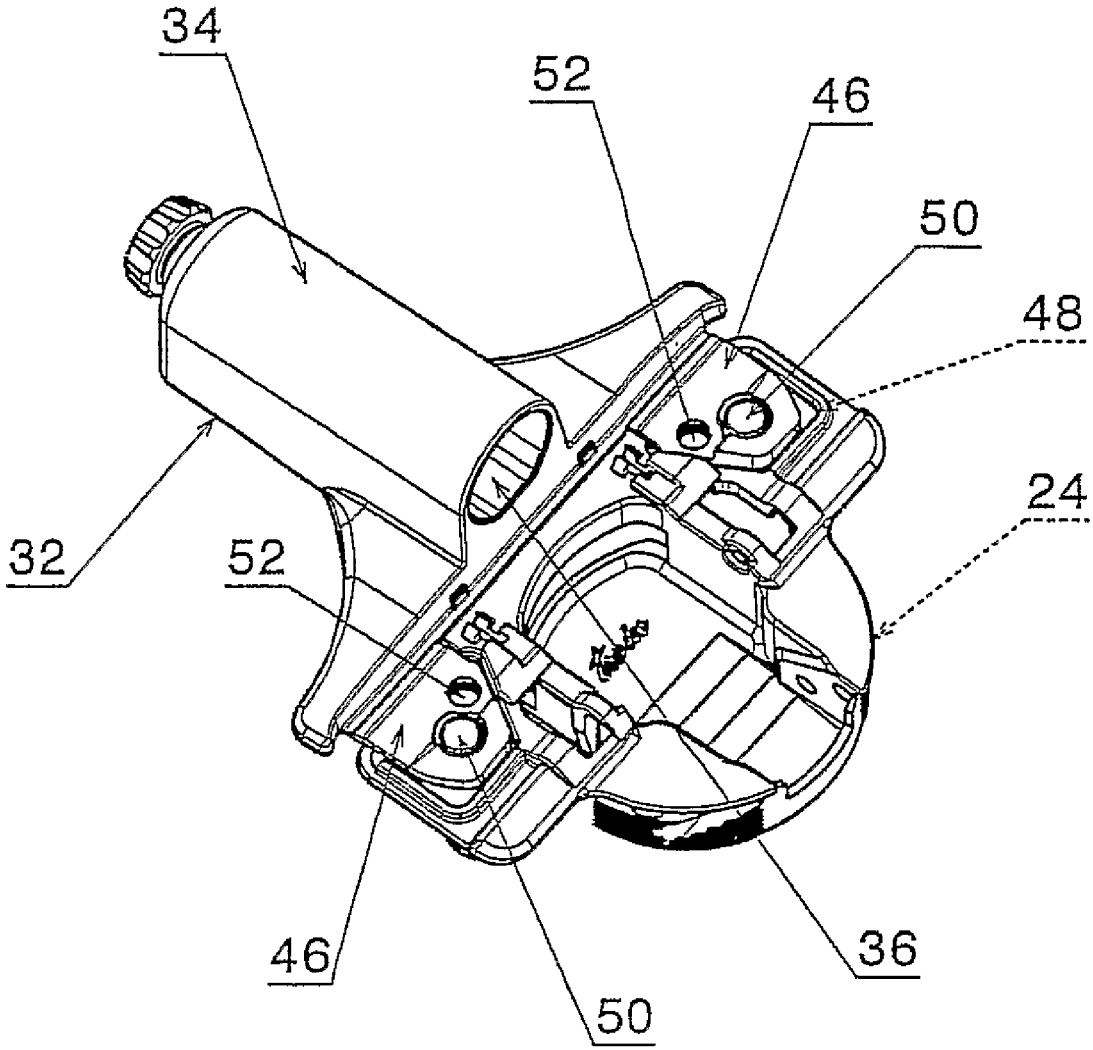

FIG. 9 shows a perspective view of the damper housing of the embodiment shown in FIGS. 6 to 8, in which appertaining door leaf mounting part of the hinge which is constructed as a hinge cup is not shown, and FIG. 10 shows a perspective view of the hinge cup of a hinge with a construction and arrangement of the connecting means retaining the damper housing on the hinge cup which is different from the embodiment according to FIGS. 6 to 9.

Figure 1:
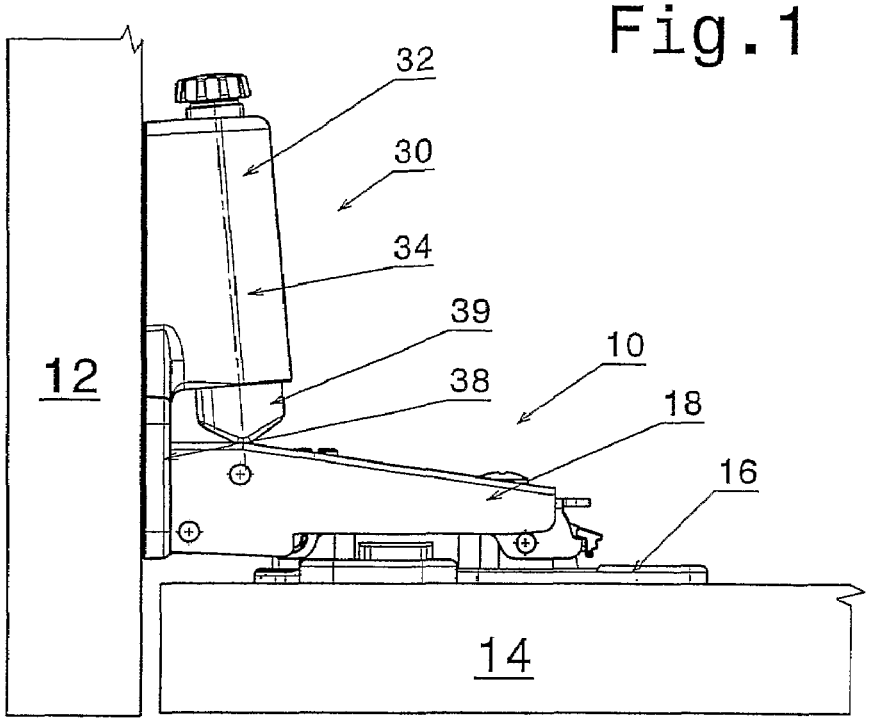
FIG. 1 shows a side view of a furniture hinge which articulates the door leaf of a cupboard pivotably on the supporting wall of the cupboard carcass, the mounting part of the furniture hinge associated with the door leaf being provided with a damping device constructed according to the invention, in the closed position.
Figure 2:
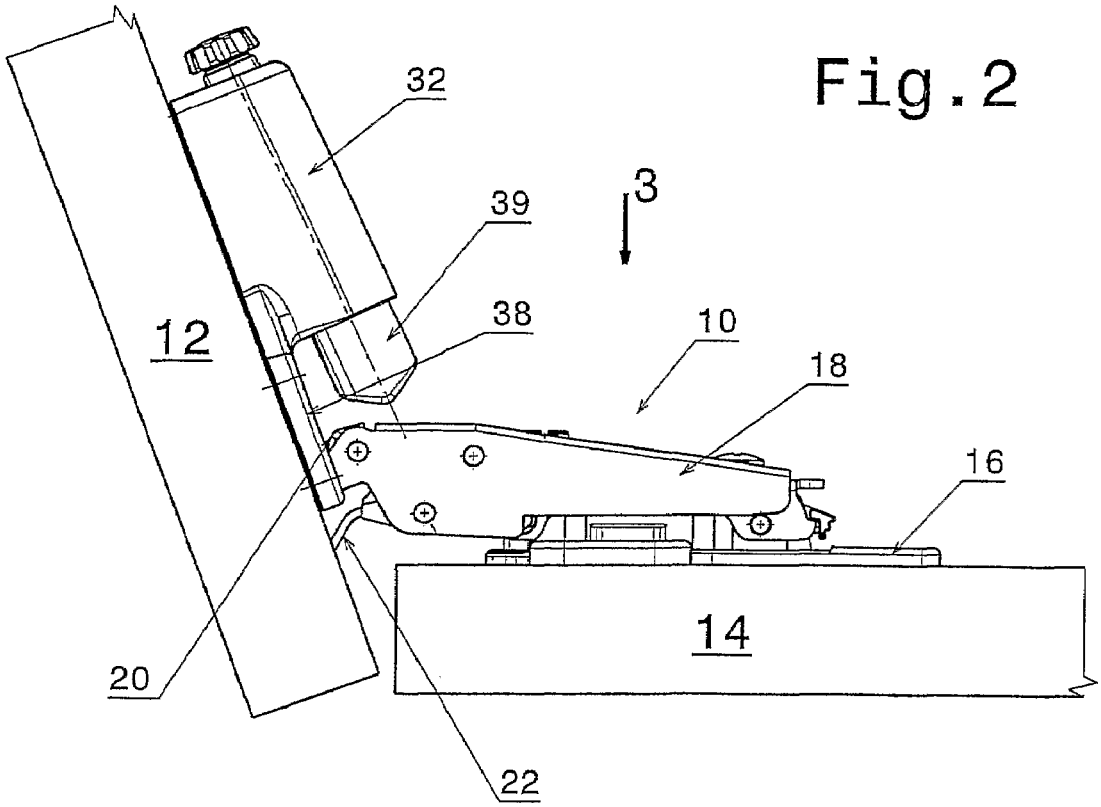
FIG. 2 shows a view corresponding to FIG. 1 in which the door leaf is shown in the partially opened position.

FIGS. 1 and 2 show a furniture hinge which is denoted in its entirety by 10 and is constructed as a four-way hinge and by means of which a door leaf 12 is pivotably articulated on the supporting wall of the carcass of a cupboard. The hinge is constructed as a four-way hinge which is known per se in which a supporting arm 18 which can be adjustably fixed on a mounting plate 16 fixed on the supporting wall 14 is coupled by way of two hinge linking elements 20 and 22 to a hinge cup 24 which can be fixed countersunk in the recess.

Figure 3:
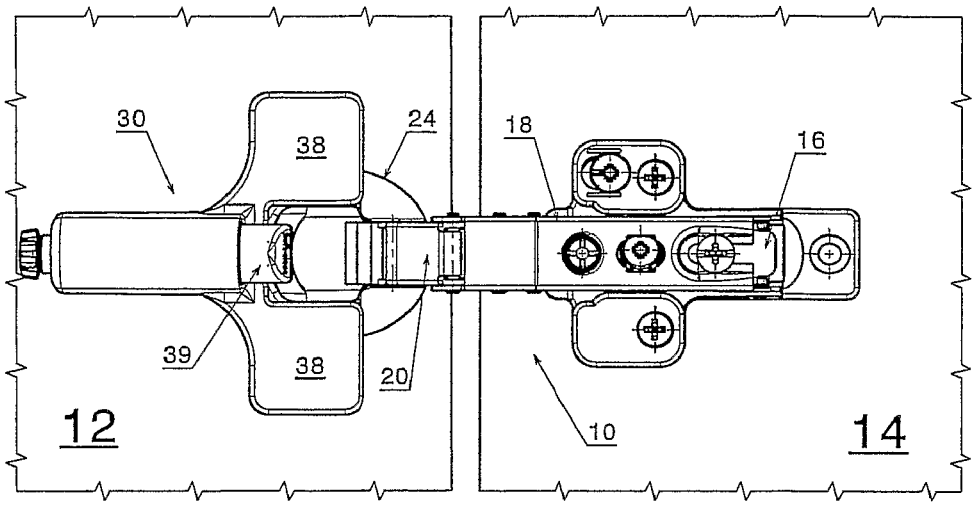
FIG. 3 shows a plan view of the hinge shown in FIGS. 1 and 2, viewed in the direction of the arrow 3 in FIG. 2, but in which the hinge is shown in the completely open position.
Figure 4:
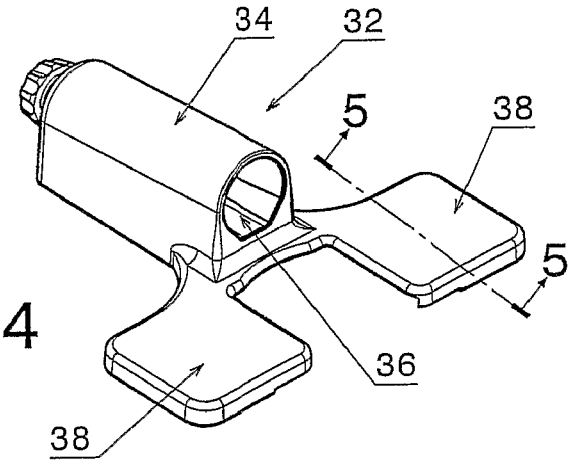
FIG. 4 shows a perspective view of the damper housing of the damper device.
Figure 5:
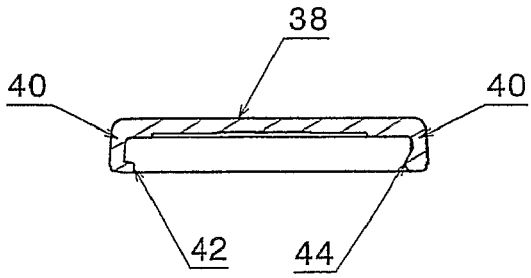
FIG. 5 shows a sectional view through one of the fixing flanges of the damper housing, viewed in the direction of the arrows 5-5 in FIG. 4.

A separately produced damping device 30 with a damper housing 32 is fixed on the hinge cup 24. The damper housing 32 has an elongate housing portion 34 which is aligned with the longitudinal central plane of the hinge cup 24 and points away from the free end edge of the door leaf 12. In the housing portion 34 there is provided a cylindrical cavity 36 which is open on the side closest to the hinge cup and serves to receive the functional components of the actual damper which is constructed as a piston damper. Of these function components, FIGS. 1 to 3 only show the end which projects out of the damper housing 32 of a ram 39 connected to the end of the piston rod of the damper, which ram moves onto the supporting arm 18 during the process of closing the door leaf 12 as the latter approaches the closed position and during the rest of the closing operation exhibits the desired braking or damping effect.

Two fixing flanges 38 which project laterally and in the direction of the hinge cup 24 are integrally cast onto both sides of the end of the housing portion 34 closest to the hinge cup, wherein these fixing flanges are shaped so that they correspond substantially to the fixing flanges of the hinge cup (not shown in the drawings) which are usually provided on the hinge cup 24 and bear on the inner face of the door leaf 12 and wherein these fixing flanges are provided in their edge region with a projecting narrow edge portion 40 which engages over the edges of the fixing flanges of the door leaf mounting part in the prescribed fixing position on the hinge cup 24. Thus the fixing flanges 38 of the damper housing 32 can be placed onto the fixing flanges of the hinge cup 24, so that the fixing flanges are then received so as to fit in space formed in the interior of the fixing flanges 38 of the damper housing 32.

The fixing of the damper housing 32 mounted on the hinge cup 24 takes place in the simplest case by projections 42 which project inwards from the peripheral narrow edge portions. These projections allow latching of the fixing flanges 38 onto the associated fixing flanges of the hinge cup and engage under the edges of the fixing flanges of the hinge cup in the prescribed fixing position of the damping device 30. It can be seen that the damping device constructed in this way can be simply and quickly attached to and removed from hinge cups already installed on the associated door leaf 12. Thus retrofitting of undamped normal hinges onto a design with end position damping is possible at any time and without difficulties.

FIGS. 6 to 8 show a variant of a damping device 30 according to the invention which is intended for hinges in which special hinge cups 24—which can be installed without tools—are used, such as are known for example from EP 0 610 765 A1 or DE 297 17 508 U1. These are hinges in which the door leaf mounting part constructed as a hinge cup is additionally provided in the region of its fixing flanges with a plate 44 which is intended for covering of the fixing flanges and/or actuation of additional fixing means for the mounting part and which at least covers parts of the fixing flanges in the prescribed covered or fixed position bearing on the fixing flanges, wherein the said plate is disposed so that it can be pivoted up about an axis a extending parallel to the hinge pivot axis on the hinge cup 24. In this case it is advantageous for the damper housing 32 to be connected to the plate 44 to form an integral component in the manner shown in FIG. 9. In other words, by raising of the end of the damper housing remote from the hinge cup and the resulting pivoting up of the plate 44 about the axis a the fixing means which retain the hinge cup in the appertaining recess in the door leaf are released and the hinge cup can be removed from the door leaf—without the use of tools.

FIG. 10 shows a hinge cup 24 which can be installed or removed without tools in a comparable manner, i.e. by pivoting up of a plate which covers the actual fixing flanges about the axis a, wherein the plate 44 which can be pivoted up is not shown for the sake of better illustration of the manner of installation of the separately produced damper housing 32 on the hinge cup.

The damper housing 32 is—in a variant of the damper housing 32 of the previously described embodiment—instead of an integrally formed plate—provided with thin flat tab-like extensions 46 which after pivoting up of the separate fixing plate (not shown) can be placed onto the upper face of the fixing flanges 48 of the hinge cup 24. In the thin tab-like extensions there are provided holes 50 in which lugs (not shown) projecting from the upper face of the fixing flange 48 of the hinge cup 24 engage. In this case by lowering of the plate covering the fixing flanges 48 of the hinge cup 24 the damper housing 32 and thus the damping device 30 as a whole is fixed on the hinge cup 24.

The fixing of the tab-like extensions 46 can be additionally secured by screwing to the door leaf. For this purpose a further through bore 52 is provided in each of the tab-like extensions of the damper housing 32 of the damping device 30, and an aligned bore in the fixing flanges 48 of the hinge cup 24 is associated with each of these through bores. Thus a fixing screw can be screwed into the door leaf through each of the bores 52 and the aligned bores in the hinge cup, so that the damper housing 32 is also secured against lifting off from the fixing flanges 48 of the hinge cup 24 when the fixing plate which covers these fixing flanges is pivoted up.

What is claimed is:

1. A combination comprising a damping device and a hinge for providing pivotable articulation of a door leaf on a carcass of a piece of furniture, wherein the hinge comprises a supporting wall mounting part fixed on a supporting wall of the carcass and a door leaf mounting part pivotably coupled to the supporting wall mounting part via a linkage mechanism, wherein the door leaf mounting part is fixed on an tinner face of the door leaf, wherein the door leaf mounting part is countersunk and engages in a recess in the door leaf and has laterally projecting fixing flanges which bear on the inner face of the door leaf, wherein the damping device comprises a damper housing provided on the door leaf mounting part, a fluid or gaseous damping medium in a cavity of the damping device, and a resistance element movable relative to the damping medium and coupled to an actuating element extending out of the damper housing, wherein, at least during part of a pivoting movement of the supporting wall and door leaf mounting parts relative to one another, the actuating element is in engaged connection directly or indirectly with the supporting wall mounting part and transmits relative movement of the supporting wall and door leaf mounting parts to the resistance element as the supporting wall and door leaf mounting parts pivot, wherein the damper housing is a separate component with laterally projecting fixing flanges fixable on the fixing flanges of the door leaf mounting part, wherein at least some areas of the fixing flanges of the damper housing are shaped to correspond substantially to an outer boundary of the fixing flanges of the door leaf mounting part and have, in an edge region, a projecting narrow edge portion adapted to engage edges of the fixing flanges of the door leaf mounting part in a prescribed fixing position on the door leaf mounting part, wherein fixing means are provided for releasable connection of the projecting narrow edge portion of the fixing flanges of the damper housing to the edges of the fixing flanges of the door leaf mounting part.

2. The combination according to claim 1, wherein the fixing means are formed by projections on the projecting narrow edge portion of the fixing flanges of the damper housing, wherein the projections are adapted to be latched on or under the edges of the fixing flanges of the door leaf mounting part.

3. The combination according to claim 1, further comprising a plate in a region of the fixing flanges of the door leaf mounting part, wherein the plate is adapted to cover the fixing flanges of the door leaf mounting part and/or to actuate additional fixing means for the door leaf mounting part, wherein the plate is adapted to at least cover parts of the fixing flanges of the door leaf mounting part in a prescribed covered or fixed position bearing on the fixing flanges of the door leaf mounting part, wherein the plate is disposed so that the plate is pivotable up about an axis (a) extending parallel to a hinge pivot axis on the door leaf mounting step-part, wherein the damper housing and the plate are combined into one integral component.

4. The combination according to claim 1, further comprises a plate in a region of the its-fixing flanges of the door leaf mounting part, wherein the plate is adapted to cover the fixing flanges of the door leaf mounting part and/or to actuate additional fixing means for the door leaf mounting part, wherein the plate is adapted to at least cover parts of the fixing flanges of the door leaf mounting part in a prescribed covered or fixed position bearing on the fixing flanges of the door leaf mounting part, wherein the plate is disposed so that the plate is pivotable up about an axis (a) extending parallel to a hinge pivot axis on the door leaf mounting part, wherein the fixing flanges of the damper housing are formed by thin flat tab-like extensions adapted to only cover parts of the fixing flanges of the door leaf mounting part and which, when the plate of the door leaf mounting part is pivoted up, to be placed on associated areas of the fixing flanges of the door leaf mounting part, wherein the thin flat tab-like extensions are adapted to be releasably connected to the fixing flanges of the door leaf mounting part and to be covered and secured against separation from the door leaf mounting part after the plate of the door leaf mounting part has been pivoted down.

5. The combination according to claim 4, further comprising fixing projections and recesses in regions of the thin flat tab-like extensions of the damper housing and the fixing flanges of the door leaf mounting part, wherein the fixing projections and recesses are adapted to interengage each other so as to interlock.

6. The combination according to claim 5, further comprising at least one through hole in each of the thin flat tab-like extensions of the damper housing, wherein the at least one through hole is adapted to be placed onto an associated projection of the fixing flanges of the door leaf mounting part, wherein the associated projection has a complementary shape in cross-section with respect to the at least one through hole.

7. A combination according to claim 5, further comprising at least one aligned through hole in the regions of the thin flat tab-like extensions of the damper housing and opposing regions of the fixing flanges of the door leaf mounting part which lie one above the other in the prescribed covering or fixing position, wherein the at least one aligned through hole is adapted to receive a shank of an additional fixing screw.

* * * * *